US007800307B2

(12) United States Patent
Tsukamoto et al.

(10) Patent No.: US 7,800,307 B2
(45) Date of Patent: Sep. 21, 2010

(54) ELECTRODE AND EXTRA-HIGH PRESSURE DISCHARGE LAMP USING THE SAME

(75) Inventors: Takuya Tsukamoto, Hyogo (JP); Yoshihiro Horikawa, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 313 days.

(21) Appl. No.: 12/149,811

(22) Filed: May 8, 2008

(65) Prior Publication Data

US 2008/0315771 A1 Dec. 25, 2008

(30) Foreign Application Priority Data

May 8, 2007 (JP) ..... 2007-123153

(51) Int. Cl.
*H01J 17/04* (2006.01)

(52) U.S. Cl. ..... 313/631; 313/623

(58) Field of Classification Search ..... 313/623, 313/627–643, 567, 111–117, 25–27, 318.01–318.09; 439/615, 739; 445/24, 22, 26, 29
See application file for complete search history.

(56) References Cited

U.S. PATENT DOCUMENTS 6,559,600 B1 5/2003 Wada et al.
6,897,613 B2 5/2005 Wada et al.

FOREIGN PATENT DOCUMENTS

JP 11-176385 A 7/1999
JP 3623137 B2 12/2004

*Primary Examiner*—Peter J Macchiarolo
*Assistant Examiner*—Donald L Raleigh
(74) *Attorney, Agent, or Firm*—Rader, Fishman & Grauer PLLC

(57) ABSTRACT

An electrode for an extra-high pressure discharge lamp, comprises large diameter portion which is symmetrical with respect to an axis of the electrode, a small diameter portion connected to the large diameter portion, wherein the large diameter portion is connected to the small diameter portion through an outer surface portion of the electrode, wherein a stripe lines like pattern portion, extending along an electrode axis direction, is formed on a portion to be brought in contact with glass of a lamp, and wherein unevenness is formed over an entire circumference of the electrode in a cross sectional view of the electrode taken along a direction perpendicular to the electrode axis direction.

6 Claims, 7 Drawing Sheets

FIG. 4A

| Sample Lamp | Ry (μm) | Sm(μm) | Breakage Rate% | Judgment |
|---|---|---|---|---|
| Sample 1 | 0.3 | 50.1 | 9.8 | × |
| Sample 2 | 1.1 | 10.5 | 5.3 | × |
| Sample 3 | 1.5 | 20.1 | 0.0 | ○ |
| Sample 4 | 2.1 | 2.7 | 0.0 | ○ |
| Sample 5 | 2.3 | 25.3 | 1.9 | × |
| Sample 6 | 2.6 | 15.6 | 0.0 | ○ |
| Sample 7 | 3.1 | 33.6 | 6.6 | × |
| Sample 8 | 4.2 | 30.3 | 1.8 | × |
| Sample 9 | 5.3 | 25.2 | 3.4 | × |
| Sample 10 | 6.6 | 2.2 | 1.8 | × |
| Sample 11 | 7.1 | 25.1 | 1.9 | × |
| Sample 12 | 10.1 | 40.8 | 3.4 | × |
| Sample 13 | 10.1 | 5.3 | 0.0 | ○ |
| Sample 14 | 12.2 | 19.1 | 0.0 | ○ |
| Sample 15 | 15.3 | 15.7 | 0.0 | ○ |
| Sample 16 | 18.1 | 8.3 | 0.0 | ○ |
| Sample 17 | 20.2 | 20.5 | 0.0 | ○ |
| Sample 18 | 20.8 | 40.7 | 5.2 | × |
| Sample 19 | 21.4 | 10.8 | 5.4 | × |
| Sample 20 | 30.6 | 45.7 | 1.9 | × |
| Sample 21 | 50.2 | 60.6 | 11.3 | × |

Specification of Lamp 350 W, Φ0.6
Amount of Hg contained 350 mg/cc

FIG. 4B

| Sample Lamp | Ry (μm) | Sm(μm) | Lamp Spec | Hg Amount | Breakage Rate (%) | Judgment |
|---|---|---|---|---|---|---|
| Sample a | 2.0 | 1.6 | 100W, φ0.3 | 250mg/cc | 0.0 | ○ |
| Sample b | 2.0 | 20.7 | 100W, φ0.3 | 250mg/cc | 0.0 | ○ |
| Sample c | 19.2 | 19.1 | 100W, φ0.3 | 250mg/cc | 0.0 | ○ |
| Sample d | 18.4 | 7.5 | 100W, φ0.3 | 250mg/cc | 0.0 | ○ |
| Sample e | 7.3 | 13.0 | 230W, φ0.4 | 300mg/cc | 0.0 | ○ |
| Sample f | 15.7 | 7.2 | 230W, φ0.5 | 300mg/cc | 0.0 | ○ |
| Sample g | 6.0 | 6.0 | 300W, φ0.5 | 320mg/cc | 0.0 | ○ |
| Sample h | 8.3 | 15.0 | 400W, φ0.6 | 280mg/cc | 0.0 | ○ |
| Sample i | 15.6 | 12.7 | 500W φ0.7 | 250mg/cc | 0.0 | ○ |
| Sample j | 3.1 | 10.6 | 500W φ0.7 | 300mg/cc | 0.0 | ○ |

FIG. 4C

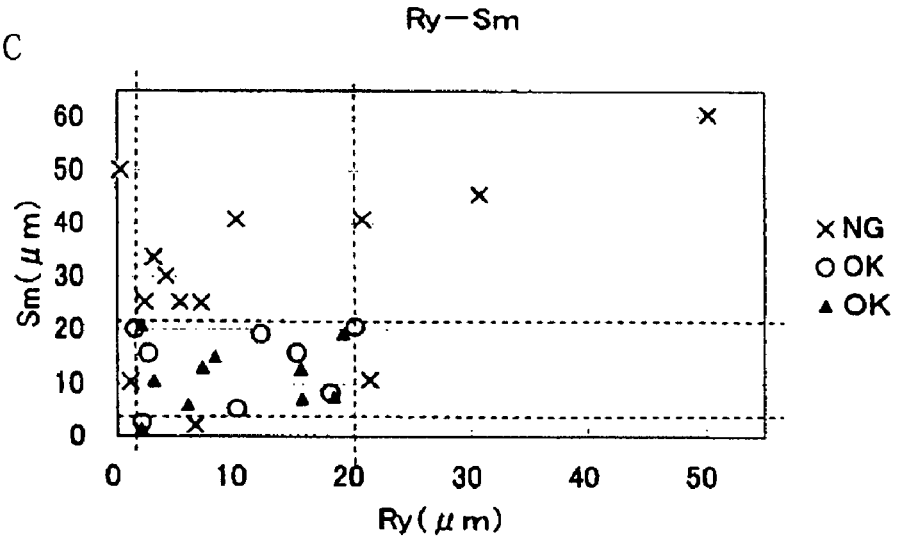

Cathode for a DC Lamp

Anode for a DC Lamp

Anode for a DC Lamp

ELECTRODE AND EXTRA-HIGH PRESSURE DISCHARGE LAMP USING THE SAME

CROSS-REFERENCES TO RELATED APPLICATION

The disclosure of Japanese Patent Application No. 2007-123153, filed May 8, 2007, including its specification, claims and drawings, is incorporated herein by reference in its entirety.

TECHNICAL FIELD

The present invention relates to an electrode for an extra-high pressure discharge lamp and an extra-high pressure discharge lamp using the same, and specifically to an extra-high pressure discharge lamp which is widely used as a light source of, for example, a projector, contains mercury in its electrical discharge space, rises to a very high pressure when the lamp is lit, and has a feature in the electrode structure, and an extra-high pressure discharge lamp which uses the electrode.

BACKGROUND

In recent years, projection type displays, such as liquid crystal projectors, have been being used widely. Especially, there are demands for projection type display apparatuses having capability of daytime use or use without turning off interior illumination. Therefore, it is demanded that a light source itself arranged in the projection type display apparatus be brighter, and have good efficiency. As such a light source, a short arc type extra-high pressure discharge lamp which contains mercury inside its electrical discharge space, and which continuously emits high intensity light in the visible light range due to a very high pressure at time of lighting is widely used.

In such extra-high pressure discharge lamps, there are a direct-current lighting type and an alternating current lighting type. As a direct-current lighting type cathode or an alternating current lighting type electrode, a melted electrode in which a coil-like member is inserted onto the tip of a rod shape-member which is made from tungsten material, and the tip thereof is melted by electric discharge etc., is used widely.

However, since it is difficult to stably form the shape thereof when melting the tip portion of the melted electrode at the time of manufacture, an electrode produced by cutting work was proposed, and has been reduced to practice in some areas. Such an extra-high pressure discharge lamp and an electrode for an extra-high pressure discharge lamp are disclosed in, for example, Japanese Patent No. 3,623,137.

In FIG. 7, a conventional extra-high pressure discharge lamp and an electrode arranged in the conventional extra-high pressure discharge lamp, are shown. FIG. 7 is a schematic cross sectional view showing the structure of the conventional extra-high pressure discharge lamp 51. This extra-high pressure discharge lamp 51 has an electric discharge container 52 which is made of quartz glass, a pair of electrodes 53 whose tips are arranged so as to face each other in the electric discharge container 52, metallic foils 54 welded to the respective electrodes 53, and external lead rods 55, each of which is welded to the other end of the metallic foils 54. Moreover, sealing portions 56, each of which is formed by bringing part of the electrode 53, the metallic foil 54, and the external lead rod 55 into close contact with glass, are formed. The electrodes 53 are made from tungsten material. A tip portion 53*a* of each electrode 53 having a large outer diameter, and an axis portion 53*b* having a small outer diameter connected to the tip portion 53*a* are formed on the electrode by cutting work. Moreover, the axis portion 53*b* is made up of an embedded portion 53*c* buried so as to be surrounded by the glass material of the sealing portion 56, and a projection portion 53*d* which projects in the electric discharge container 52.

When carrying out cutting work on the electrode 53, in the conventional processing method, one end of the electrode material made from rod shape tungsten material is held, and using a numerical control lathe (NC lathe) etc., a chip for cutting is pressed onto an outer circumference surface of the electrode material while rotating it, and the chip for the cutting is moved in an axial direction of the rod shape tungsten material. Thus, minute unevenness (cutting marks) approximately in a direction perpendicular to the electrode axial direction is formed over the entire electrode surface of the processed electrode.

In the conventional extra-high pressure discharge lamp, cracks are generated in the sealing portions formed by bringing the electrode into close contact with the glass, and there is a problem that the extra-high pressure discharge lamp itself is broken in some cases. This phenomenon appears more notably as the contact area of the electrode and the glass is larger. This attributes to stress which is generated in the glass since the difference of thermal expansion coefficient is generated between the expansion contraction of the electrode and the expansion contraction of the glass in close contact with the electrode when the extra-high pressure discharge lamp repeats light-on and light off.

A measure to such cracks is known, as disclosed in, for example, Japanese Laid Open Patent No. H11-176385. The Laid Open Patent discloses the technology of preventing generation of cracks by inserting a coil-like member in the sealing portion which is formed so that the electrode may be in close contact with the glass and making the close contact area of the electrode and the glass small, so as to ease the stress generated in an interface with glass. However, although the entire lamp comes to be exposed at a higher temperature as an output of the extra-high pressure discharge lamp itself is higher, the problem of cracks has not been fully solved only by the conventional technology, so that there is a problem that reliability cannot be obtained as the extra-high pressure discharge lamp. Moreover, with demands of the market, while developments of lamps according to much higher pressure power specification, which are lamps with high light emission efficiency, progress, fine cracks which have not been considered by now, become problematic as a factor of breakage. Moreover, since the reliability over breakage-proof was not enough, there was a problem that the extra-high pressure discharge lamp with a long-life span could not be produced.

SUMMARY

In view of the above, in order to solve the problem, proposed is an electrode for an extra-high pressure discharge lamp capable of preventing breakage of the extra-high discharge lamp due to cracks generated at a sealing portion (embedded portion) of the electrode. Moreover, by having such an electrode, it is possible to offer an extra-high discharge lamp with long life span and high reliability against breakage.

The present electrode for an extra-high pressure discharge lamp, comprises large diameter portion which is symmetrical with respect to an axis of the electrode, a small diameter portion connected to the large diameter portion, wherein the large diameter portion is connected to the small diameter portion through an outer surface portion of the electrode, wherein a stripe lines like pattern portion, extending along an electrode axis direction, is formed on a portion to be brought in contact with glass of a lamp, and wherein unevenness is formed over an entire circumference of the electrode in a cross sectional view of the electrode taken along a direction perpendicular to the electrode axis direction. In the electrode, since the portion having fine stripes pattern or hair lines like scratches along the axial direction of the electrode, is formed so that a concavo-convex portion is formed over the entire circumference of the electrode in a cross-sectional view of the electrode, taken along a direction perpendicular to the axial direction, when an extra-high pressure discharge lamp is produced using the electrode, for example, it is possible to suppress generation of fine cracks in the glass material which is brought into contact with the electrode, by the expansion/contraction due to the heat at time of seal processing, and it is also possible to prevent breakage of the lamp resulting from cracks generated at the embedded portion of the electrode buried so as to be surrounded by glass material in the sealing portion.

In the electrode, in an area of a reference length L which is a length in a circumference direction and is equal to one fourth of a diameter D, when a diameter of the electrode is represented as D, a height Ry and an average value Sm may be in a range of 1.5 μm≦Ry≦20.2 μm and 2.7 μm≦Sm≦20.5 μm, wherein a height from a bottom portion which most goes down in a roughness curve and a top section which is most projected in the roughness curve is represented as a maximum height Ry, and an average value of cycle distances, each of which is obtained from a projected portion and a fallen portion specified by crossing intersections of an average line and the roughness curve, is represented as Sm. Since the size of unevenness in a circumference direction may be within a range of 1.5 μm≦Ry≦20.2 μm and 2.7 μm≦Sm≦20.5 μm according to the invention in claim 2, it is possible to ease moderately a degree of contact with the glass and a surface of the electrode, and it is also possible to prevent generation of cracks with certainty. Furthermore, in the extra-high pressure discharge lamp in which the electrode is installed, since a large gap is not formed between the glass and the electrode, it is possible to prevent mercury to enter the gap whereby it is possible to solve the problem that the pressure rapidly increase at local points thereof immediately after the lamp is lit, thereby causing breakage of the extra-high pressure discharge lamp.

In the electrode, a direction in which stripe lines of the stripe lines like pattern extend along the electrode axis may be approximately the same as a lamp axis direction. Accordingly, since the concavo-convex portion which is a strip scratch like portion and which is formed over the entire circumference in a cross-sectional view taken along a direction perpendicular to the axial direction, and the lamp axial direction of the extra-high pressure discharge lamp are approximately in agreement, even if thermal expansion/contraction occurs due to repetition of light-on and light-off, it is possible to prevent a problem that the extra-high pressure discharge lamp is broken for a short time due to the cracks generated in the embedded portion of the electrode. As a result, there is an advantage that the reliable extra-high pressure discharge lamp against breakage can be produced.

In view of the above-mentioned problems, a short arc type extra-high pressure discharge lamp may comprise an electrical discharge container with optical permeability in which 0.15 mg/mm$^3$ or more of mercury is enclosed, a pair of electrodes which face each other, and metallic foils buried in respective sealing portions formed at both ends of the electrical discharge container in which the metallic foils are welded to respective ends of the electrodes, wherein the metallic foils and part of the electrodes are enclosed in glass, wherein at least one of the electrodes has a large diameter portion which is symmetrical with respect to the lamp axis, and a small diameter portion connected to the large diameter portion, in which the large diameter portion is connected through an outer surface so that the large diameter portion, the small diameter portion and the outer surface are integrally formed, wherein a surface of the at least one of the electrodes which is enclosed in the glass of the electrode, has a stripe lines like pattern portion, wherein unevenness is formed over the entire circumference of the at least one of the electrodes in a cross sectional view thereof taken along a direction perpendicular to an axis direction of the at least one of the electrodes.

In the short arc type extra-high pressure discharge lamp, in an area of a reference length L which is a length in a circumference direction and is equal to one fourth of a diameter D, when a diameter of the at least one of electrodes is represented as D, a height Ry and an average value Sm may be in a range of 1.5 μm≦Ry≦20.2 μm and 2.7 μm≦Sm≦20.5 μm, wherein a height from a bottom portion which most goes down in a roughness curve and a top section which is most projected in the roughness curve is represented as a maximum height Ry, and an average value of cycle distances, each of which is obtained from a projected portion and a fallen portion specified by crossing intersections of an average line and the roughness curve, is represented as Sm.

In the short arc type extra-high pressure discharge lamp, a direction in which stripe lines of the stripe lines like pattern portion extend along the electrode axis may be approximately a same as a lamp axis direction.

At least one end of the electrode for an extra-high pressure discharge lamp, is buried in glass of a sealing portion of the extra-high pressure discharge lamp. Since the electrode has a stripe scratch-like section extending in an axial direction of the electrode, at a portion of the electrode which is in contact withy the glass and stripe scratch line like portion, so that a concavo-convex portion is formed over the entire circumference of the electrode in a cross-sectional view taken along a direction perpendicular to the axial direction, even thermal expansion or contraction occurs, in a sealing process at time of manufacture, or by repetition of light-on and light off, it is possible to suppress generation of the cracks at the embedded portion of the electrode, thereby suppressing breakage of the extra-high pressure discharge lamp resulting from the cracks.

BRIEF DESCRIPTION OF THE DRAWINGS

Other features and advantages of the present electrode, and extra-high pressure discharge lamp using the electrode will be apparent from the ensuing description, taken in conjunction with the accompanying drawings, in which:

FIG. 4A is a table showing a breakage occurrence rate of lamps having an electrode for an extra-high pressure discharge lamp;

FIG. 4B shows a result of a lighting examination in case where the specification of an extra-high pressure discharge lamp is changed;

FIG. 4C shows a table made based on the data shown in FIGS. 4A and 4B.

DESCRIPTION

Figure 1:
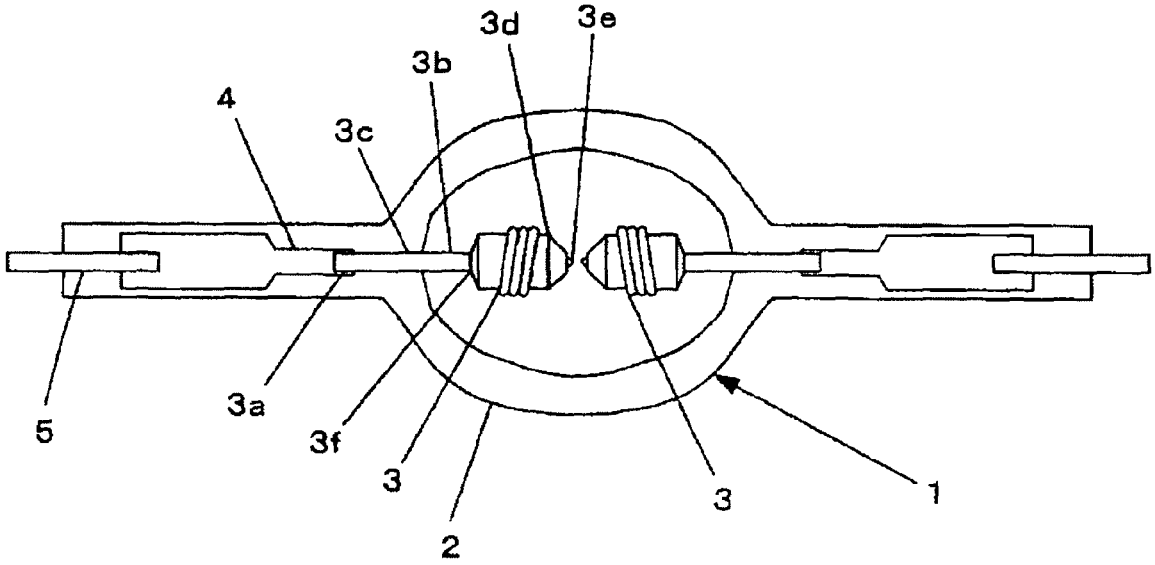
FIG. 1 is a schematic diagram showing the structure of an extra-high pressure discharge lamp according to the present invention.

A first embodiment is described referring to FIG. 1.

FIG. 1 is a schematic cross sectional view showing an entire extra-high pressure discharge lamp according to embodiment. The extra-high pressure discharge lamp 1 has, for example, an electric discharge container 2 made of quartz glass with optical permeability, in which a pair of electrodes 3 which face each other is provided. Each of metallic foils 4 made of Mo is welded to one end portion 3*a* of the electrode 3. Each of external lead rods 5 is welded to the other end of the metallic foil 4. In the electric discharge container 2, mercury, rare gas, and a very small quantity of halogen is enclosed. In this embodiment, an AC lighting type lamp is used in which the maximum outer diameter of the electric discharge container 2 is ϕ10 mm, the internal volume thereof is 65 $mm^3$, the distance between these electrodes is 1.0 mm, and an input at the time of lighting is 230 W. Moreover, mercury of 0.15 $mg/mm^3$ is enclosed therein, and argon gas is enclosed as the rare gas. Each of the electrode 3 has a tip portion 3*d* which corresponds to a large diameter portion which is approximately axis-symmetrical with respect to a lamp axis, and an axis portion 3*b* which is a small diameter axis portion and is connected to the tip portion 3*d*. The tip portion 3*d* and the axis portion 3*b* are connected through an outer surface 3*f*, so that the tip portion 3*d*, the axis portion 3*b* and the outer surface 3*f* are integrally formed. The diameter of the axis portion 3*b* is ϕ0.4 mm. As material thereof, pure tungsten material of high purity (5N quality) is used. On a surface of a contact section 3*c* of the axis portion 3*b* of the electrode 3 which is in contact with the glass material of the electric discharge container 2, fine unevenness which consists of line scratch like portion extending along the axial direction of the electrode 3 is formed over the entire circumference of the electrode in a cross-sectional view of the electrode taken along a direction perpendicular to the axial direction. The electrode 3 is produced by, for example, cutting a pure tungsten rod material having ϕ1.4 mm with an NC lathe etc. and then etching the cut rod with chemical(s), so that the full length thereof is 7 mm, the diameter of the axis portion 3*b* is ϕ0.4 mm and the diameter of the tip portions 3*d* is ϕ1.2 mm. A projection portion 3*e* is provided on an end portion of the tip portion 3*d*. The cutting work of the electrode 3 is generally performed by holding one end of the electrode material made from a rod shape tungsten material, pressing a chip for cutting on the outer circumferential surface of the electrode while rotating the electrode about the center of the electrode axis extending to a longitudinal direction, and moving the chip for the cutting. After the cutting work, cutting marks in shape of minute unevenness, which extends approximately in a direction perpendicular to the electrode axial direction are formed over the entire electrode surface. The cutting marks in shape of minute unevenness disappear by sufficiently carrying out etching processing with chemical, so that the shape of the primary recrystallization grain extending in the axial direction, which is inherent in the electrode material made from rod shape tungsten material, appears. The shape of this primary recrystallization grain appears as the stripe scratch line-like section along the axial direction of the electrode 3, in which fine unevenness is formed over the entire circumference of the electrode in a cross sectional view or the electrode taken along a direction perpendicular to the axial direction.

Figure 2:
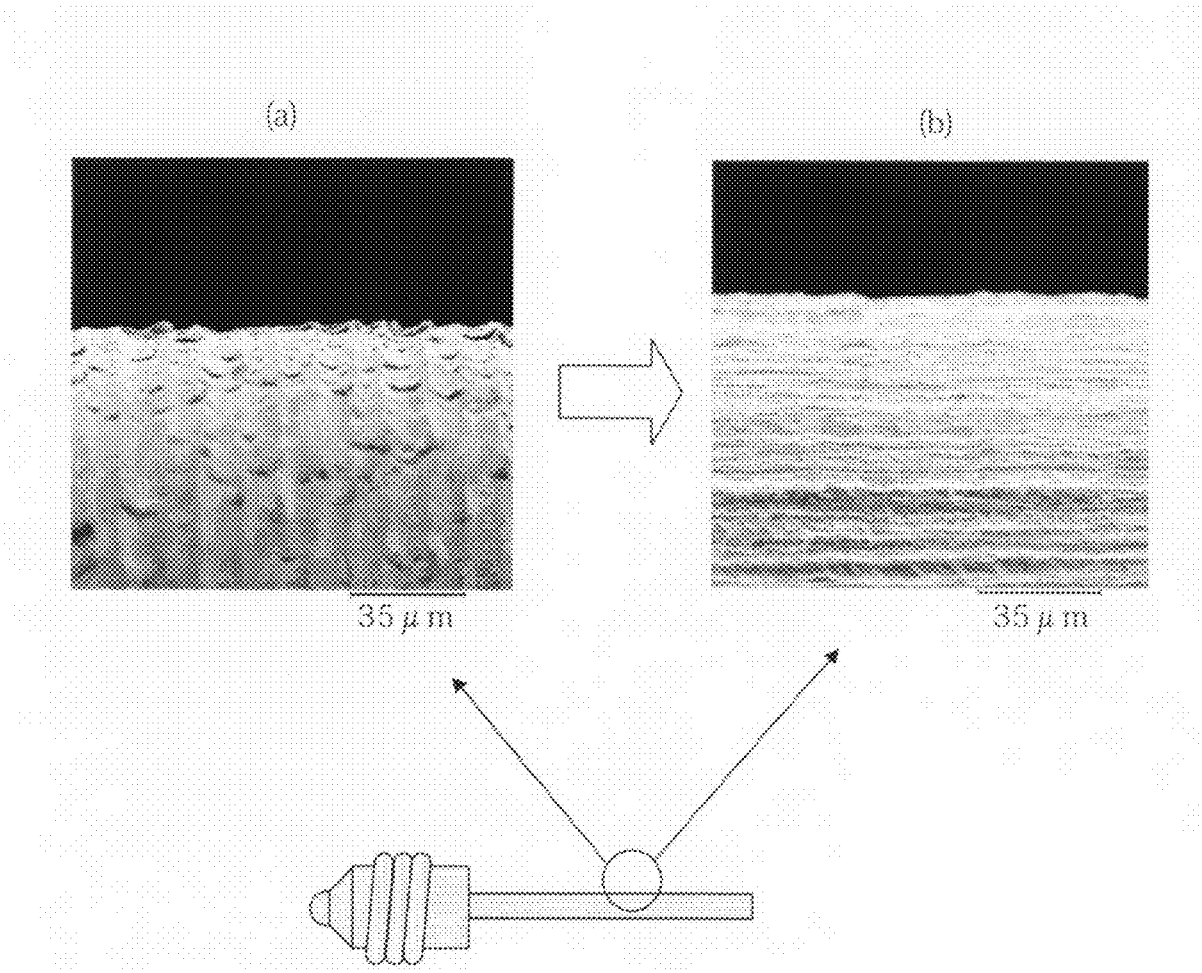
FIG. 2 shows SEM photographs showing surface states of the electrode for an extra-high pressure discharge lamp.

FIG. 2 shows SEM (scanning electron microscope) photographs in order to compare a surface state (a) at time after cutting work of the electrode is carried out, with a surface state (b) at time when etching processing is done after the cutting work is carried out. These SEM photographs show enlarged views of the surface portion of the electrode, in which the horizontal direction of the photographs corresponds to the electrode axial direction. In FIG. 2(*a*), the cutting marks are formed by carrying out the cutting work with a lathe in a direction perpendicular to the electrode axial direction, so that the line unevenness is formed on the surface of the electrode along the axial direction. FIG. 2(*b*) is the SEM photograph of an enlarged surface portion of the electrode, which was taken when performing etching processing after cutting work of the electrode, in which the horizontal direction of the photograph corresponds to the electrode axial direction as in FIG. 2A. After the etching processing, the cutting marks of the electrode, which extend in a direction perpendicular to the electrode axial direction disappear, and the fine stripe scratch-line pattern along the electrode axial direction can be seen entirely. The shape of the primary recrystallization grain which extends in the axial direction and which the electrode material made of rod shape tungsten material inherently has, can be seen as the stripe scratch line-like shape pattern. The shape of this primary recrystallization grain is the stripe scratch-like shape or fine hair lines like shape along the axial direction of the electrode, that is, fine unevenness formed over the entire circumference of the electrode in a cross-sectional view of the electrode taken along the electrode axial direction.

According to this embodiment, since the fine unevenness is formed on the surface of the contact section 3*c* of the axis portion 3*b* of the electrode 3 which is brought into contact with the glass material of the electric discharge container 2, so as to be formed over the entire circumference of the electrode in a cross sectional view thereof taken along a direction perpendicular to the axial direction of the electrode 3, it is possible to suppress generation of cracks in a side of the glass material which forms the electric discharge container 2, at the time of lamp manufacture.

The mechanism of suppressing these cracks is considered as set forth below. Softened glass is brought into contact with the surface of the electrode 3, during the seal process of the extra-high pressure discharge lamp. At this time, if the cutting marks in the direction perpendicular to the electrode axial direction appears on the surface of the electrode 3, the electrode and the glass are joined to each other, with the reversed shape corresponding to the cutting marks of the electrode formed in the glass side. Then, after the sealing is completed, the glass joined once is separated from the surface, due to difference between the thermal-expansion of the glass and that of tungsten at time of cooling. At this time, the fine unevenness which is the cutting marks formed in the electrode side with the larger amount of displacement due to the heat contraction, engages with (catches) the fine unevenness which is formed in the glass side and which has the reversed shape of the cutting marks, thereby producing cracks. However, according to the embodiment, the minute unevenness along the axial direction of the electrode 3 is formed so as to cover the entire circumference of the electrode in a cross-sectional view of the electrode, whereby the reversed shape of unevenness of the glass which is formed when the glass and the electrode 3 are brought into close contact with each other at the time of sealing, is formed as the stripe scratch line-like shape along the axis of the electrode having a large thermal expansion. Moreover, even if the electrode 3 is greatly displaced in the axial direction with respect to the glass due to a thermal expansion difference after the sealing is completed, since the fine unevenness along the axial direction of the electrode 3 is formed all over the entire circumference of the electrode, the electrode 3 is pressed onto the unevenness in the reversed shape which is formed in the glass side without engaging with the reversed shape unevenness, whereby cracks are not produced. That is, the direction of expansion/contraction is approximately the same as a direction in which the lines scratches extend.

Figure 3A:
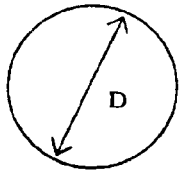
FIG. 3A shows a cross sectional view of an electrode taken along a direction perpendicular to an electrode axial direction.
Figure 3B:
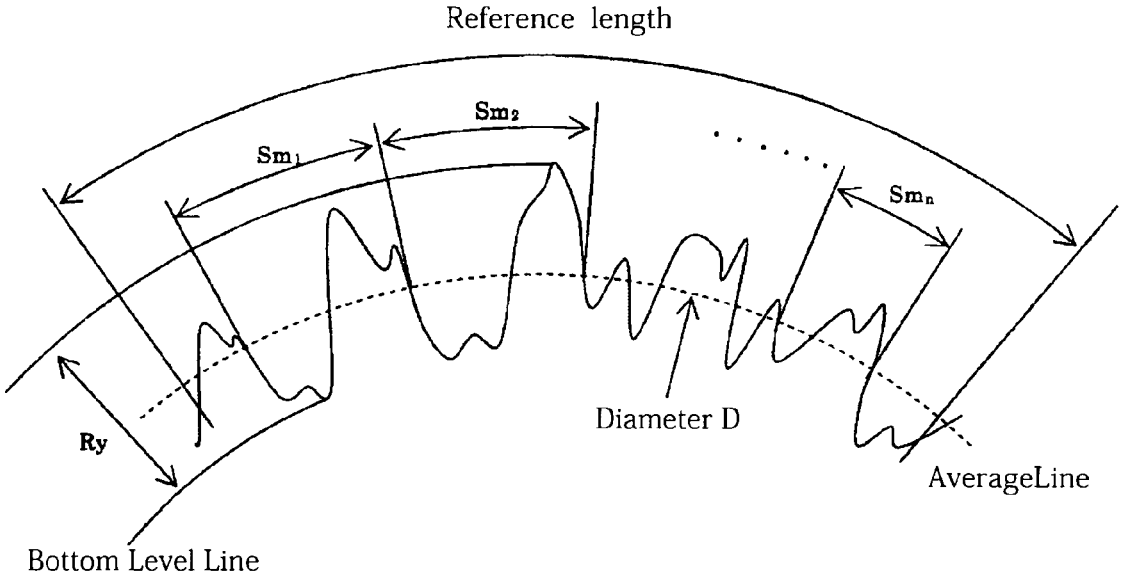
FIG. 3B is an enlarged schematic diagram showing part of a cross sectional view of an electrode in which a curve showing roughness of a fine unevenness is shown.

Next, FIGS. 3A and 3B show an explanatory diagram about an index for evaluating the fine unevenness which is the stripe scratch line-like shape formed on the electrode in the axial direction of the electrode, and which covers all over the circumference of the electrode in a cross sectional view of the electrode taken along a direction perpendicular to the electrode axial direction. This index is based on the regulation of Japanese Industrial Standards (JIS B 0601-1994).

FIG. 3A shows a cross sectional view of the electrode taken along a direction perpendicular to the electrode axial direction. FIG. 3B is an enlarged schematic diagram showing part of the cross sectional view of the electrode in which a curve shows roughness of the fine unevenness. In FIG. 3A, the diameter of the electrode is represented as D, and in FIG. 3B, a length in the circumference direction which is equal to one fourth of the length of the diameter D is represented as a reference length L. FIG. 3B shows a circumference portion of the electrode cut out by the reference length L and shows the roughness curve. This roughness curve shows the shape of fine unevenness in a range of the reference length L. The distance in the height direction (a distance in the diameter direction in a cross sectional view of the electrode) between the bottom section which most goes down and the top section which is most projected in the roughness curve is represented as a maximum height Ry.

Next, in the figure, an average line is obtained from the average height of projected sections and fallen sections of the roughness curve in the range of the reference length L. The average of cycle distances, each of which is obtained from a projected portion and a fallen portion specified by the crossing intersections of the average line and the roughness curve, is represented as Sm. Evaluation of such fine unevenness which has the shape of stripe lines extending along the electrode axis direction, and which covers all over the circumference thereof in a cross sectional view of the electrode taken along a direction perpendicular to the electrode axial direction is performed, using the reference length L, the maximum height Ry and the average value Sm of the cycle distance of the projected and fallen portions.

FIGS. 4A and 4B are tables showing a result of a lighting examination of various electrodes, each of which was installed in an extra-high pressure discharge lamp, wherein the maximum height Ry, μm (micrometer) between the bottom section and the top section and the average Sm μm (micrometer) of cycle distances, each of which was obtained from a projected portion and a fallen portion, were variously changed. In this example, an AC lighting type lamp was used as an extra-high pressure discharge lamp, in which 350 mg/cc of mercury was enclosed in an electric discharge container, and the lighting voltage was 350 W. Moreover, the diameter of the axis portion of the electrode for the extra-high pressure discharge lamps was set to ϕ0.6 mm. Moreover, an electrode axis having a comparatively long distance in a cross sectional view, and having a large embedded portion with which the glass was brought into contact was used as samples. The relation between the values Ry and Sm and the breakage occurrence rate of a discharge lamp is shown in FIG. 4A.

As shown in FIG. 4A, twenty one (21) samples (Sample 1 to 21) in which the value of Ry was increased gradually from 0.3 to 50.2 were prepared. The value of Sm of each of the samples was also measured. Here, in the samples 3, 4, 6, and 13-17, the breakage occurrence rate was 0%, even after the lamp was lit, so that the sample was rated as O.K. as a result of judgment (a symbol ○ in the figure). As to other samples, lamps were damaged and these samples were rated as NG as a result of a judgment (a symbol x in the figure). In addition, as to the breakage occurrence rate (%), 50-60 lamps in the same condition were prepared and the existence of breakage was checked by lighting examination.

FIG. 4C shows a graph made based on the data shown in FIGS. 4A and 4B. FIG. 4C is a graph in which the values of Ry and Sm of the respective samples are plotted, wherein a vertical axis the graph shows Sm μm (micrometer), and a horizontal axis shows Ry μm (micrometer). In FIG. 4C, among the samples shown in FIG. 4A, samples having zero percent (0%) breakage occurrence rate are plotted as good samples (samples 3, 4, 6, 13-17), using the symbol ○. Furthermore, the extra-high pressure discharge lamps shown in FIG. 4B described below corresponds to samples whose breakage occurrence rate was 0%. In FIG. 4C, good samples are plotted by a symbol ▲. Moreover, in the other samples which are shown in FIG. 4A, lamps were damaged, and these samples were plotted by a symbol x as NG samples in FIG. 4C. As shown in dashed line in the figure, when the values of Ry and Sm are in a range of 1.5 μm≦Ry≦20.2 μm and 2.7 μm≦Sm≦20.5 μm, respectively, the breakage occurrence rate was 0%.

Next, FIG. 4B shows a result of the lighting examination in case where the specification of the extra-high pressure discharge lamp was changed. In samples a to d, lamps whose input electric power was 100 W, whose electrode core diameter was ϕ0.3 mm, and whose mercury amount contained in an electric discharge container was 250 mg/cc, were used. Similarly, in samples e and f, lamps whose input electric power was 230 W, whose electrode core diameter was ϕ0.4 mm (sample e), ϕ 0.5 mm.(sample f), respectively and whose mercury amount contained in an electric discharge container was 300 mg/cc, were used. In sample g, input electric power was 300 W, the electrode core diameter was ϕ0.5 mm, and the amount of mercury contained in an electric discharge container was 320 mg/cc. Moreover, in sample h, input electric power was 400 W, the electrode core diameter was ϕ0.6 mm, and the amount of mercury contained in an electric discharge container was 280 mg/cc. Moreover, in sample i, input electric power was 500 W, the electrode core diameter was ϕ0.7 mm, and the amount of mercury contained in an electric discharge container was 300 mg/cc. In these extra-high pressure discharge lamps but the specification was changed, in which the values of Ry and Sm of the electrode core were within a fixed range, there was no case where breakage occurred in the lighting examination.

In the graph of FIG. 4C, the data (of good sample) of FIG. 4B is shown by a solid black triangle symbol. Thus, even in the cases of the extra-high pressure discharge lamp in which the specification was changed, as shown by the dashed line in FIG. 4C, in the case where the values of Ry and Sm were in the range of 1.5 μm≦Ry≦20.2 μm and 2.7 μm≦Sm≦20.5 μm, the breakage occurrence rate was 0%.

Figure 5:
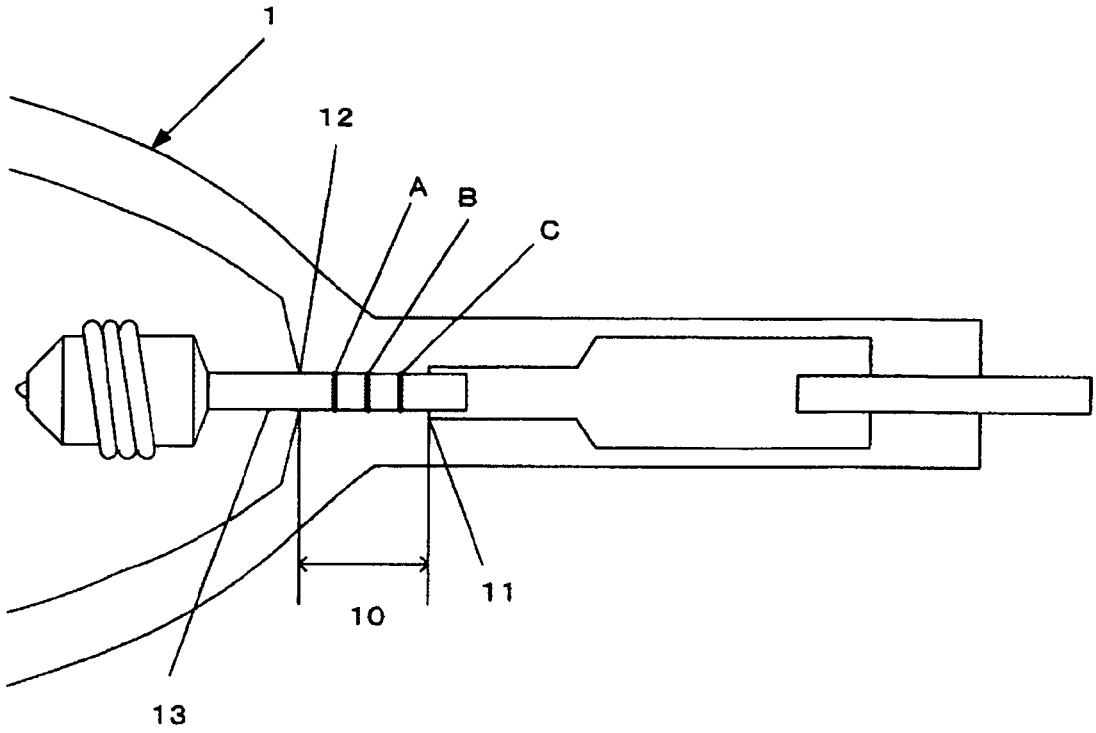
FIG. 5 is an explanatory diagram showing a measured portions of an electrode for an extra-high pressure discharge lamp according to the present invention in the surface state.

In addition, specifically, Sm and Ry shown in FIGS. 4A and 4B were measured at virtual lines drawn at equal. intervals in an explanatory view shown in FIG. 5. That is, the virtual lines A, B and C were located on the glass embedded portion 10 of the extra-high pressure discharge lamp 1 and were obtained by quartering the distance in the axial direction between a foil end portion 11 in the electrical discharge space side and an electrical discharge space side end portions 12 of the glass embedded portion 10. Ry and Sm were measured along the lines, over the entire circumferences of the electrode 13 by a laser displacement meter with 0.01 μm resolution.

Figure 6A:
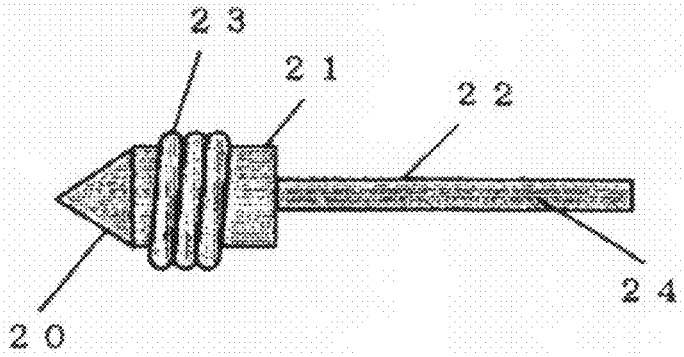
FIGS. 6A, 6B, and 6C are schematic diagrams showing another embodiment of an electrode for an extra-high pressure discharge lamp according to the present invention.
Figure 6B:
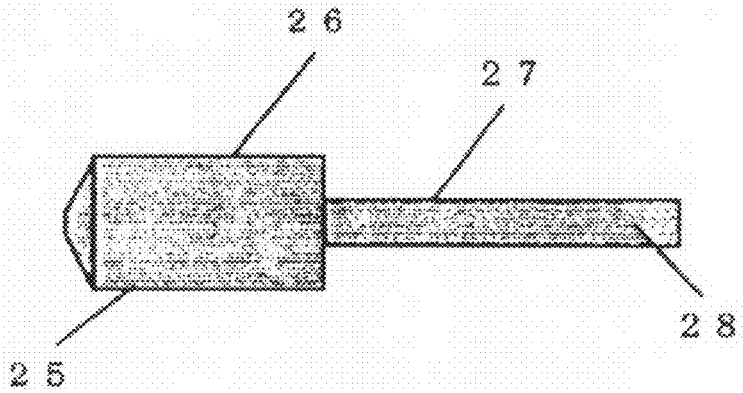
Figure 6C:
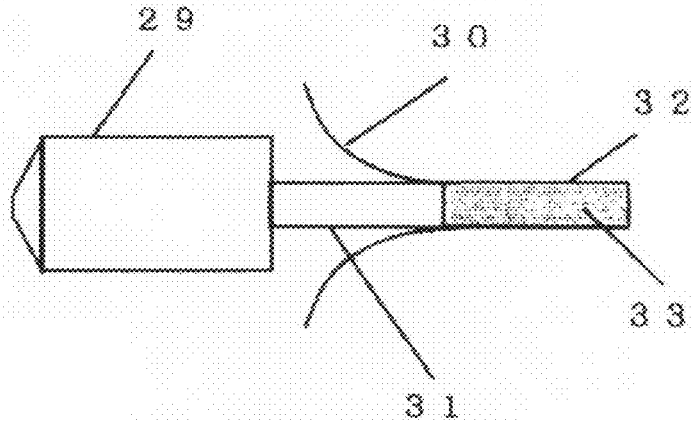
Figure 7:
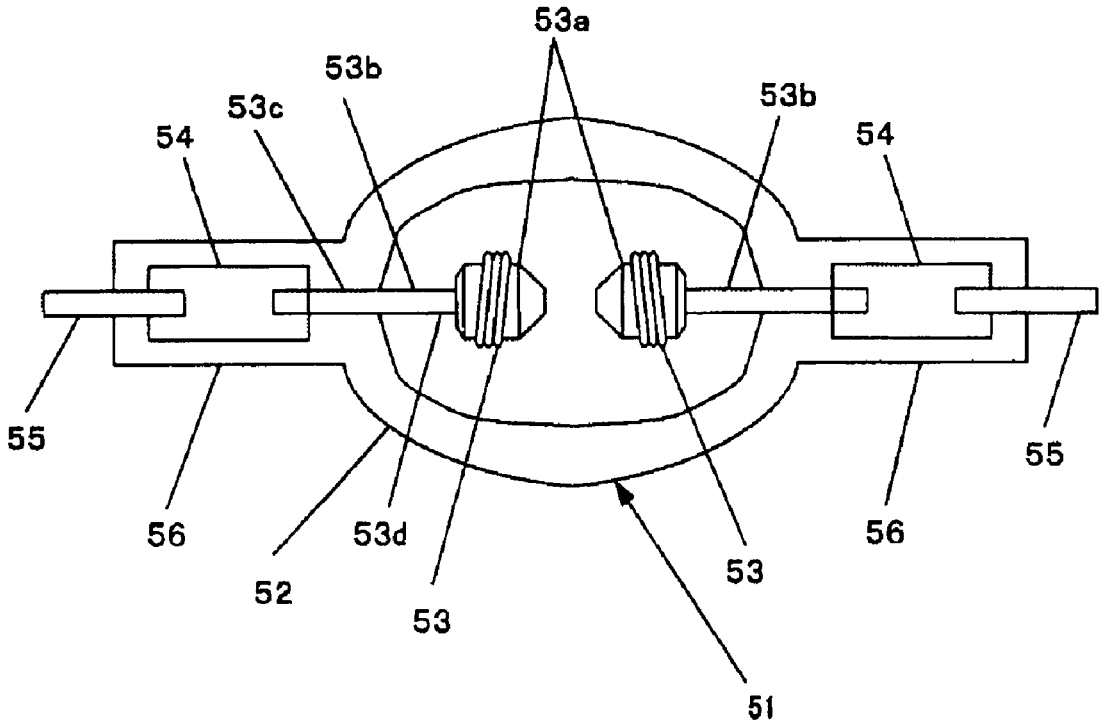
FIG. 7 is a schematic diagram showing the structure of a conventional extra-high pressure discharge lamp.

FIGS. 6A, 6B and 6C shows another embodiment of the electrode. Although in the first embodiment, an example of the electrode used in an AC lighting lamp is described, in this embodiment, a cathode and an anode used in a DC lighting lamp will be described below. The DC lamp has the same effect against breakage as that of the DC lamp, by forming fine stripe scratch line-like unevenness along an electrode axial direction, on lead portions of the cathode and the anode which are in contact with the glass.

FIG. 6A is a schematic diagram showing the shape of the cathode of the DC lighting lamp. A large diameter portion 21 which is a thick portion is provided at the tip of the cathode. A lead rod portion 22 which continues to the large diameter portion 21, is provided. The large diameter portion 21 and the lead rod section 22 are formed by cutting work from one rod shape material. Moreover, the coil 23 is winded around the large diameter portion 21. By carrying out etching processing on the entire cathode 20, the fine stripe scratch lines-like unevenness 24 is formed on the entire cathode 20 in the axial direction of the cathode 20.

FIG. 6B shows the shape of the anode 25 of the DC lighting lamp. The anode 25 is also carved out from one rod shape material by cutting work, and is made up of the large diameter portion 26 in a tip side and a lead rod portion 27 which continues to the large diameter portion 26. It is required that the large diameter portion 26 of the anode 25 have sufficient heat capacity. Therefore, the heat capacity of the anode 25 is larger than that of the cathode for the DC lighting. As in the case of the cathode, by carrying out etching processing on the entire anode 25, the fine stripe scratch lines-like unevenness 28 along the axial direction of the anode 25 is formed on the entire anode 25.

FIG. 6C shows an anode 29 for the DC lighting. The anode 29 is carved out by cutting work from one rod shape material as in the case of FIG. 6B. However, the area on which etching processing is carried out, is only a portion adjacent to an end portion 32 of the lead rod section 31 which is brought into contact with the glass 30 after seal processing. The fine stripe scratch lines-like unevenness 33 along the axial direction of the anode 29 is formed on the end portion 32 by the etching processing. In addition, in this embodiment, although etching processing is used as means for producing the fine stripe scratch line-like unevenness along the axial direction of the electrode, other methods, for example, electrolytic polishing, laser processing, milling cutter processing according to a high precision milling machine, etc. may be adopted.

The preceding description has been presented only to illustrate and describe exemplary embodiments of the electrode and extra-high pressure discharge lamp using the electrode according to the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An electrode for an extra-high pressure discharge lamp, comprising:

a large diameter portion which is symmetrical with respect to an axis of the electrode, a small diameter portion connected to the large diameter portion, wherein the large diameter portion is connected to the small diameter portion through an outer surface portion of the electrode, wherein a linear groove pattern portion extending along an electrode axis direction, is formed on a portion to be brought in contact with glass of a lamp, and wherein unevenness is formed over an entire circumference of the electrode in a cross sectional view of the electrode taken along a direction perpendicular to the electrode axis direction.

2. The electrode according to claim 1, wherein in an area of a reference length L which is a length in a circumference direction and is equal to one fourth of a diameter D, when a diameter of the electrode is represented as D, a height Ry and an average value Sm are in a range of 1.5 μm≦Ry≦20.2 μm and 2.7 μm≦Sm≦20.5 μm, wherein a difference between a minimum point in a roughness curve and a maximum point in a roughness curve is represented by Ry, and an average value of the cycle distances, each of which is obtained from said maximum and minimum points specified by crossing intersections of an average line and the roughness curve, is represented as Sm.

3. The electrode according to claim 2, wherein the linear groove pattern extends along the electrode axis in approximately the same direction as the lamp axis.

4. A short arc type extra-high pressure discharge lamp comprising:

an electrical discharge container with optical permeability in which 0.15 $mg/mm^3$ or more of mercury is enclosed, a pair of electrodes which face each other, and metallic foils buried in respective sealing portions formed at both ends of the electrical discharge container in which the metallic foils are welded to respective ends of the electrodes, wherein the metallic foils and part of the electrodes are enclosed in glass, wherein at least one of the electrodes has a large diameter portion which is symmetrical with respect to the lamp axis, and a small diameter portion connected to the large diameter portion, in which the large diameter portion is connected through an outer surface so that the large diameter portion, the small diameter portion and the outer surface are integrally formed, wherein a surface of the at least one of the electrodes which is enclosed in the glass has a linear groove pattern portion wherein unevenness is formed over the entire circumference of the at least one of the electrodes in a cross sectional view thereof taken along a direction perpendicular to an axis direction of the at least one of the electrodes.

5. The short arc type extra-high pressure discharge lamp according to claim 1, wherein in an area of a reference length L which is a length in a circumference direction and is equal to one fourth of a diameter D, when a diameter of the at least one of electrodes is represented as D, a height Ry and an average value Sm are in a range of 1.5 μm≦Ry≦20.2 μm and 2.7 μm≦Sm≦20.5 μm, wherein a difference between a minimum point in a roughness curve and a maximum point in a roughness curve is represented by Ry, and an average value of the cycle distances, each of which is obtained from said maximum and minimum points specified by crossing intersections of an average line and the roughness curve, is represented as Sm.

6. The short arc type extra-high pressure discharge lamp according to claim 2, wherein the linear groove pattern extends along the electrode axis in approximately the same direction as the lamp axis.

* * * * *